US006748622B2

(12) United States Patent
Lee et al.

(10) Patent No.: US 6,748,622 B2
(45) Date of Patent: Jun. 15, 2004

(54) WATER CIRCULATION CLEANER

(75) Inventors: Seong Bin Lee, Siheung-Si (KR); Hyeun Sik Nam, Seoul (KR)

(73) Assignee: LG Electronics Inc., Seoul (KR)

( * ) Notice: Subject to any disclaimer, the term of this patent is extended or adjusted under 35 U.S.C. 154(b) by 172 days.

(21) Appl. No.: 10/042,151

(22) Filed: Jan. 11, 2002

(65) Prior Publication Data

US 2002/0148071 A1 Oct. 17, 2002

(30) Foreign Application Priority Data

Apr. 13, 2001 (KR) ..... 2001-19884

(51) Int. Cl.[7] ..... A47L 11/30; A47L 9/16
(52) U.S. Cl. ..... 15/320; 15/353
(58) Field of Search ..... 15/320, 322, 353

(56) References Cited

U.S. PATENT DOCUMENTS 4,462,137 A * 7/1984 Berfield et al. ..... 15/353
5,299,608 A * 4/1994 Bosyj ..... 141/285
5,354,347 A * 10/1994 McCoy et al. ..... 96/330

FOREIGN PATENT DOCUMENTS

JP 2001-95737 * 4/2001

* cited by examiner

*Primary Examiner*—Terrence R. Till
(74) *Attorney, Agent, or Firm*—Fleshner & Kim, LLP

(57) ABSTRACT

A water circulation cleaner is provided which is capable of easily removing contaminants on a cleaning object through the use of an improved suction head. A plurality of injection nozzles are used to spray cleaning water onto a surface of an object to be cleaned, and a suction port then sucks debris and fluid off of the surface of the cleaning object. An impeller assembly is used to generate this suction force, while a filter device removes debris contained in the suction fluid from the cleaning water. A brush and a duster may be affixed to a lower surface of the suction area of the cleaner, and can be used either alone or in combination to loosen debris from the surface of the object to be cleaned, thus facilitating removal by suction of the debris, and the effective and efficient cleaning of the object.

31 Claims, 8 Drawing Sheets

WATER CIRCULATION CLEANER

BACKGROUND OF THE INVENTION

1. Field of the Invention

The present invention relates to a vacuum cleaner and particularly, to a water circulation cleaner capable of removing contaminants on a cleaning object by enabling water cleaning.

2. Description of the Background Art

Generally, a vacuum cleaner is a cleaning instrument for sucking and removing foreign materials existing on cleaning objects by a suction force generated of a fan motor assembly installed in a main body.

Since such vacuum cleaners are composed so that it can suck and remove foreign materials by a suction force, it can remove foreign materials such as dusts and the like existing on the surface or in the vicinity of the cleaning object but it is difficult to remove foreign materials on the cleaning object or contaminants or spots on the cleaning object.

To solve the problem, recently, cleaners having a brush or duster or wet duster in a suction head of a cleaner are developed to remove foreign materials which are attached to the cleaning object and not easily separated or spots formed on the cleaning object.

However, the vacuum cleaners having a brush or duster is limited in completely separating foreign materials abutting the brush or duster on the cleaning object and accordingly cleaning efficiency is insufficient. The above vacuum cleaner also has a disadvantage that the use is inconvenient since the duster must be often shaken and replaced.

Also, such cleaner is limited in flat areas having relatively low contamination, such as floors and bottom of rooms and it is hard to use in an area with much moisture.

SUMMARY OF THE INVENTION

Therefore, the present invention is to solve the problem of the conventional art and provides a water circulation cleaner capable of easily remove foreign materials such as spots and the like as well as dusts existing on a cleaning object by sucking foreign materials on the cleaning object after injecting cleaning water on the cleaning object.

To achieve these and other advantages and in accordance with the purpose of the present invention, as embodied and broadly described herein, there is provided a water circulation cleaner, including a main case, a suction head combined to the lower side of the main case, having a suction port to suck foreign materials and fluid existing on a cleaning object surface, an impeller assembly installed at one side of the main case, for generating suction force, a filter means positioned in the suction passage between the suction head and the impeller assembly, for separating foreign materials contained in suction fluid, a cleaning water tank connected to the discharging port of the impeller assembly in the main case, for storing cleaning water inside and an injection nozzle positioned in the suction head, for injecting the cleaning water supplied from the cleaning water tank to the cleaning object surface.

Rollers are installed at the front and rear sides of the lower surface of the suction head to ease moving of the cleaner.

The suction head has either a brush member or duster member to remove foreign materials being abutted to the cleaning object on the lower surface.

The brush member and the duster member are composed to remove foreign materials from the cleaning object.

The suction head has a blade for preventing outflow of the cleaning water injected from the injection nozzle in the outer area of the suction port.

The blade has a structure that it is connected to the lower surface of the suction head in the trapezoid form.

The suction head has either a brush member or duster member to remove foreign materials being abutted to the cleaning object on the lower surface and the suction port is formed at the upper and rear side of the portion where the brush member and the duster are installed. The injection nozzle is positioned between the suction port positioned at the front and the brush member or the duster member.

The blade has an elliptic structure that it is connected to the lower surface of the suction head according to the other embodiment of the present invention.

At this time, the suction port is formed as an oval shape in the internal area of the blade and at least one between the brush member or duster member is installed at the inner side area of the suction port. The pluralities of injection nozzles are formed between the suction port and the brush member or duster member.

The blade has an end blade abutted to the bottom surface formed sloped inward where the suction port is positioned.

The suction pipe for forming a suction passage between the suction head and the filter means is connected and a backward-flow-preventing valve for preventing a backward flow so that the cleaning water does not move backwardly. The suction pipe has an expansion pipe expanded in the direction of the radius in the middle of itself.

The filter means is combined with the impeller assembly outside the main case.

The filter means is composed by the hydro-cyclone dust collection structure according to the other embodiment of the present invention.

The filter means is composed of a dust collection case having a radius narrowed along from the upper area to the lower area to form a cyclone dust collection structure by gyration movement of fluid.

The dust collection case has a protrusion port for sucking the cleaning water containing foreign materials on the upper side surface and an impeller suction tube vertically lengthened from the impeller assembly at the upper central portion The protrusion port is protruded in the direction of tangent line of the dust collection case from a flat surface and the protrusion port is formed sloped downward in the direction to the inner side of the dust collecting case.

The filter means has a filter member in a filter case and accordingly when cleaning water sucked to the filter case passes the filter member, foreign material is filtered according to the other embodiment of the present invention.

The filter means includes a filter case having a protrusion port on the side surface to suck cleaning water, a cap where an impeller suction pipe of the impeller assembly passes, being combined at the upper portion of the filter case separably and a filter member for filtering foreign materials.

The filter member includes a first filter member positioned at the inner lower portion of the filter case, having a relatively small number of meshes to filter foreign materials with large particles and a second filter member positioned at the side of the impeller suction pipe, having a relatively large number of meshes than the first filtering member to filter foreign materials with small particles.

The impeller assembly includes an impeller housing fixed to the main case, an impeller for generating a force for flowing cleaning water containing foreign materials which passed through the filter means at the lower inner portion of the impeller housing and a driving motor installed at the upper inner portion of the impeller housing, for rotary operating the impeller.

The impeller assembly further includes a sealing means positioned between the impeller and the driving motor, for preventing inflow of the cleaning water to the driving motor.

The cleaning water tank is formed in a cylindrical shape lengthened in the vertical direction, being connected with an inflow tube connected to the impeller assembly and an outflow tube connected to the injection nozzle.

The inflow tube has a pressure drawing means for lowering pressure by being opened when pressure between the exhaust side area of the impeller assembly and the cleaning water tank reaches a certain level.

The pressure drawing tube includes a pressure drawing tube diverged from the inflow tube and connected to the outside of the main case and a pressure valve installed in the pressure drawing tube, being opened when the pressure reaches a certain level.

An open/close valve for opening and closing the tank is installed in the outflow tube to prevent outflow of the cleaning water stored in the cleaning water tank.

A supply tube communicating with the outside of the main case is connected to the cleaning water tank to fill the tank with cleaning water and a cap is installed in the inlet portion of the supply tube to close the closing water tank.

The water circulation cleaner in accordance with the present invention can clean indoor areas as well as concrete floor such as bathroom and the like more cleanly by enabling water cleaning injecting cleaning water in the cleaning object area.

The foregoing and other, features, aspects and advantages of the present invention will become more apparent from the following detailed description when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Figure 1:
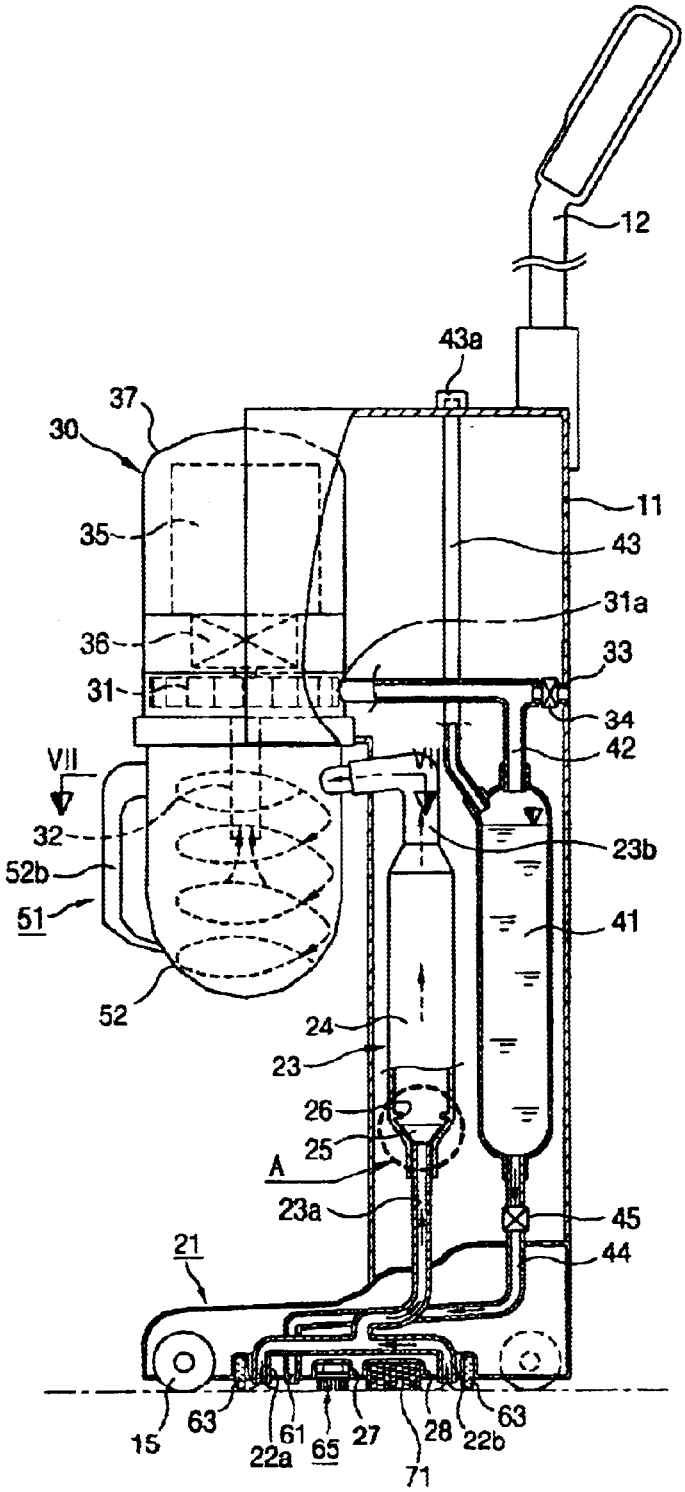
FIG. 1 is a longitudinal sectional view showing a water circulation cleaner according to an embodiment of the present invention.

Reference will now be made in detail to the preferred embodiments of the present invention, examples of which are illustrated in the accompanying drawings.

FIGS. 1 to 7 show a water circulation cleaner according to an embodiment of the present invention.

The water circulation cleaner according to an embodiment of the present invention includes a main case 11 where an accommodation space is formed, a suction head 21 positioned at the lower side of the main case 11 as a single body movably, an impeller assembly 30 installed in the main case 11, for generating suction force, a filter unit 51 positioned in the suction passage between the suction head 21 and the impeller assembly 30, for separating foreign materials contained in suction fluid, a cleaning water tank 41 connected to the discharging port 31A of the impeller assembly 30 in the main case, for storing cleaning water inside and an injection nozzle 61 positioned in the suction head 21, for injecting the cleaning water supplied from the cleaning water tank 41 to the cleaning object surface.

The components of the present invention will be described centering on the above components Firstly, in the main case 11, an accommodation space is formed lengthened in the vertical direction and a handle 12 is installed at the upper end portion so that the user can use the cleaner.

Figure 2:
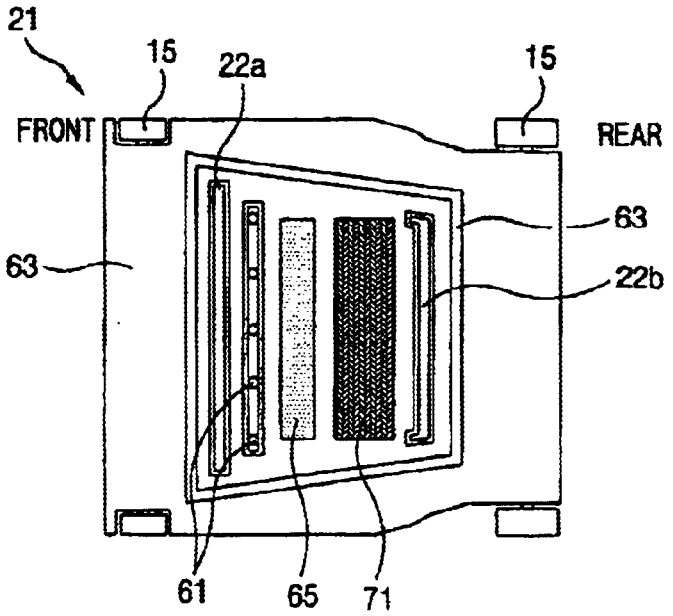
FIG. 2 is a bottom view showing a water circulation cleaner according to an embodiment of the present invention.

Then, with reference to FIGS. 1 and 2, the suction head 21 is combined to the lower side of the main case 11, rollers are installed at the front and rear sides of the bottom surface of the suction head to ease moving of the cleaner and coupling portions 27 and 28 formed as a groove shape, for installing a brush member 65 for removing foreign materials being abutted to a cleaning object and a duster member 71 detachably are formed at the center portion of the bottom.

Figure 3:
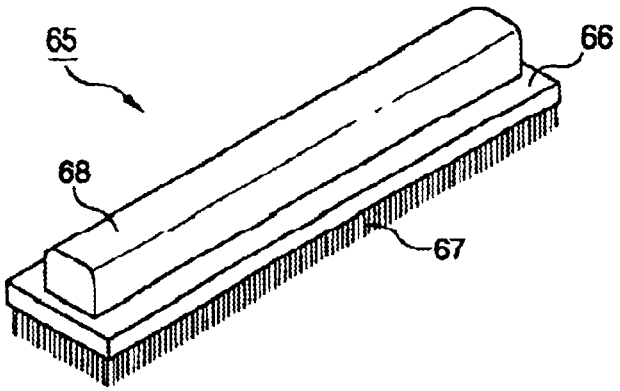
FIG. 3 is a perspective view showing a brush member abutted to the water circulation cleaner shown in FIG. 1.

As shown in FIGS. 2 and 3, the brush member 65 includes a plurality of bristles 67 installed on the lower surface of the brush case 66 and an insertion portion 68 combined to the suction head 21 being protruded on the upper surface of the brush case 66 and inserted in the coupling portion 27.

Figure 4:
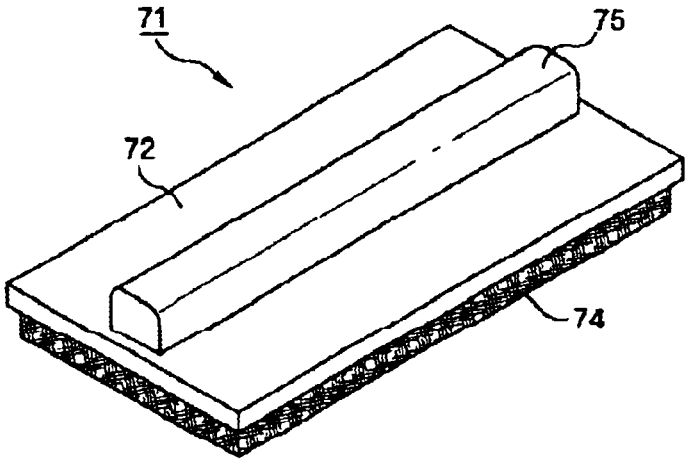
FIG. 4 is a perspective view showing a duster member abutted to the water circulation cleaner shown in FIG. 1.

As shown in FIG. 4, the duster member 71 includes a duster case 72 composed of synthetic resin member, a duster 74 composed of nonwoven fabric, cotton fabrics, sponge and the like to wipe foreign materials being abutted on the cleaning object and fixed on the bottom surface of the duster case 72 and an insertion portion 75 protruded on the upper surface of the duster case 72 and inserted in and combined to the coupling portion 28 of the suction head 21.

In the suction head 21, the brush member 65 is installed at the front and the duster member 71 is installed at the rear. Accordingly, the foreign materials separated from the cleaning object by the brush member 65 are wiped by the duster member 71 and completely removed.

Also, with reference to FIG. 2, in the suction head 21, a blade 63 is installed to form a square edge shape on the external area of the coupling portions 27 and 28 where the brush member 65 and the duster member 71 are installed. The bladed 63 is composed of rubber member and the like being abutted to the bottom surface elastically so that the cleaning water can be easily sucked under the condition that the cleaning water is positioned at the inner side of the blade square area and the cleaning water injected from the injection nozzle 61 is not flown to the outside of the area at the same time.

It is desired that the blade 63 has an trapezoid shape as shown in FIG. 2, that is, the front portion of the suction head 21 is longer than the rear portion and the side portions are formed sloped to the moving direction of the cleaner.

Figure 5:
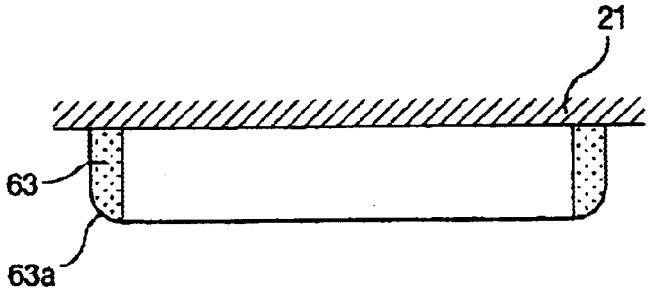
FIG. 5 is a sectional view showing a structure of a blade of the water circulation cleaner according to an embodiment of the present invention.

As shown in FIG. 5, it is desirable that the blade 63 has an end blade formed sloped inwardly and it is to flow foreign material to the internal area of the blade easily and prevent outflow of the foreign material or cleaning water in the internal area of the blade to the external area of the blade.

In the suction head 21, a pair of suction ports 22A and 22B are formed at the front and rear sides centering around the coupling portion 27 and 28 where the brush member 65 and the duster member 71 are formed so that the cleaning water and foreign material are sucked to the internal area of the blade.

Also, the plurality of injection nozzles 61 are installed between the suction port 22A positioned at the front side and the coupling portion 27 where the brush member 65 is installed to inject the cleaning water on the bottom surface of the cleaning object.

Then, as shown in FIG. 1, the suction pipe 23 vertically connected from the main case 11 is installed between the suction port 22 of the suction head 21 and the filter unit 51.

The suction pipe 23 is joined by tubes connected to the suction ports 22A and 22B and the second pipe 23B is connected to the filter unit 51. An expansion pipe 24 expanded in the radius direction is formed between the first pipe 23A and second pipe 23B. Particularly, a check valve 25 which is a backward-flow-preventing-valve for preventing backward flow of the sucked cleaning water is installed at the inlet portion of the expansion pipe 24.

Figure 6A:
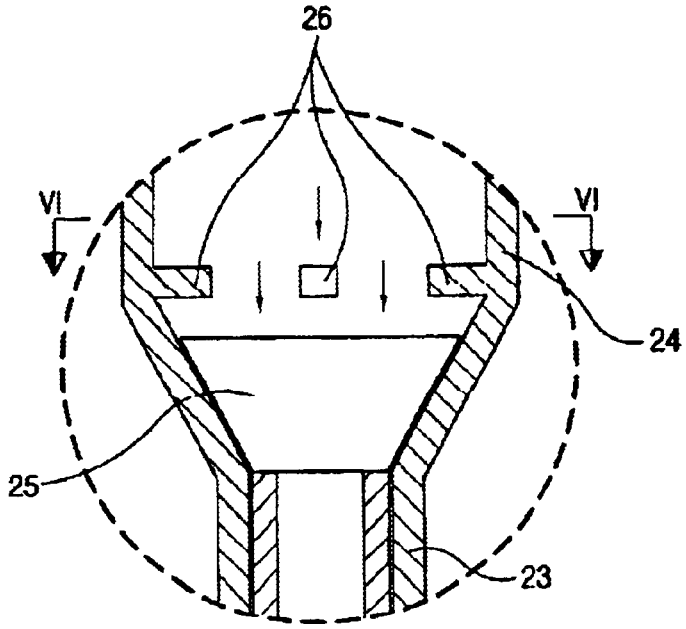
FIGS. 6A and 6B are detail views showing "A" portion of FIG. 1
Figure 6B:
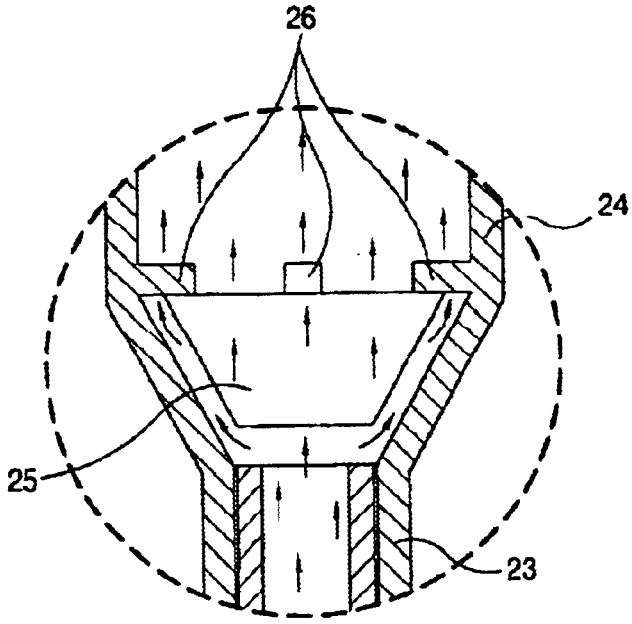
Figure 6C:
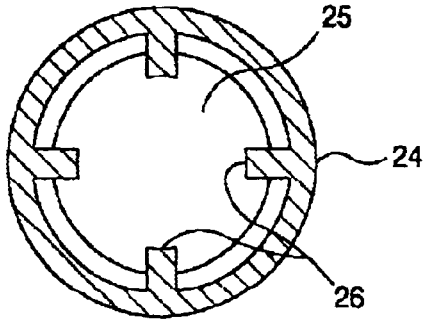
FIG. 6C is a section view taken along section line VI—VI of FIG. 6A, to describe the operation of a backward-flow-preventing-valve.

As shown in FIGS. 6A, 6B and 6C, between the first pipe 23A and the expansion pipe 24, a plurality of stoppers 26 are protruded to restrict upward flow of the check valve 25 when the cleaning water is sucked.

Then, with reference to FIG. 1, the filter unit 51 connected between the suction pipe 23 and the impeller assembly 30, for separating foreign material included in the sucked cleaning water is installed at the front side of the main case 11.

The filter unit 51 is composed of the hydro-cyclone dust collection structure.

Such filter unit 51 is composed of dust collection case 52 having a handle 52B and it is installed at the lower side of the impeller assembly 30 separably.

Figure 7:
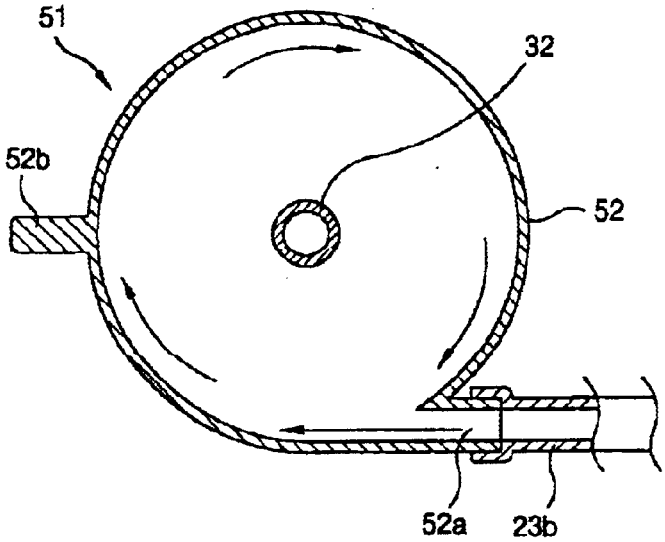
FIG. 7 is a sectional view showing a filter unit shown along section line VII—VII of FIG. 1.

As shown in FIGS. 1 and 7, the dust collection case 52 is formed as a cylindrical structure which is narrowed along from the upper area to the lower area to have a cyclone dust collection structure by gyration movement of fluid Also, the dust collection case 52 has an opened upper portion and is combined to the impeller assembly 30. At the center portion of the case, an impeller suction tube 32 expanded vertically from the impeller assembly 30 is positioned. At the upper side surface of the dust collecting case 52, a protrusion port 52A combined with the second pipe 23B of the suction pipe 23 is formed to suck the cleaning water including foreign materials.

The second pipe 23B of the suction tube 23 and the mutual connection portion of the protrusion port 52A are combined in the direction of the tangent line of the dust collection case 52 as shown in FIG. 7 at the view of a flat surface and are formed sloped downwardly in the direction of the inner side of the dust collection case as shown in FIG. 1.

Then, the impeller assembly 30 is installed at the upper portion of the main case 11 and a part of the impeller assembly 30 is installed exposed to the front side of the main case 11.

The impeller assembly 30 includes an impeller housing 37 fixed to the main case, an impeller 31 positioned at the lower inner portion of the impeller housing 37, for generating suction force so that the cleaning water including foreign materials is sucked to the suction head 21 and the filter unit 51 and a driving motor 35 installed at the upper inner portion of the impeller housing 37, for rotary operating the impeller 31.

Here, a sealing portion 36 having a mechanical seal or oil seal is positioned between the impeller 31 and the driving motor 35 to block the inflow of the cleaning water flown to the inner portion of the impeller 31 and transmit the driving force of the driving motor 35.

Then, at the inner portion of the main case, the cleaning water tank 41 is installed to supply the cleaning water to the injection nozzle 61 under the condition that the cleaning water is stored.

The cleaning water tank 41 is formed as a cylindrical shape lengthened in the upper and lower direction and an inflow tube 42 connected with the outlet port 31A of the impeller 31 is combined with the upper side of the tank. An outflow tube 44 connected to the injection nozzle 61, for injecting the cleaning water on the bottom surface is combined to the lower side.

Here, a supply tube 43 communicated from the upper portion of the main case 11 is connected to the cleaning water tank 41 to be filled with the cleaning water and a cap 43A is installed at the inlet portion of the supply tube 43 to close the cleaning water tank 41.

In the inflow tube 42, a pressure drawing tube is connected to the outside of the main case 11 and a pressure valve 34 opened when the pressure is higher than a certain level is installed in the pressure drawing tube 33 so that the pressure between the impeller which is a outlet side area and the cleaning water tank 41 can be drawn when it is higher than a certain level.

A filter member and the like can be installed at the front and rear sides of the pressure valve 34 to block moisture including the cleaning water and exhaust only air.

An open/close valve 45 is installed in the outflow tube 44 so that the cleaning water stored in the cleaning water tank does not outflow when the cleaner is not in use. It is desirable that a solenoid valve operated according to signals of a controlling part (not shown) for controlling various operations of the cleaner is applied as the open/close valve 45 and a manual valve which a user can open and close at need can be used.

The operation and the effect of the cleaner in accordance with an embodiment of the present invention with the above composition will be described as follows.

In case of cleaning bottom surface such as a floor of a bathroom or concrete floor, only the brush member 65 is combined to the suction head 21 and the cleaning water is supplied to the cleaning water tank 41 through the supply tube 43 appropriately.

Here the brush member 65 can be used being combined with the duster member 71.

Then, fluid is sucked from the bottom surface of the cleaning object through the suction ports 22A and 22B when the impeller 31 is rotary operated by applying a power to the driving motor 35 and at the same time, the pressure of the inside of the cleaning water tank 41 is increased by the exhaust pressure of the impeller 31.

Accordingly, the cleaning water stored in the cleaning water tank 41 flows along the outflow tube 44 and is injected to the bottom surface through the respective injection nozzles 61 positioned at the lower portion of the suction head 21.

When the user moves the suction head 21 in the front and rear directions holding a handle under the condition that the cleaning water is injected on the bottom surface to be cleaned, dusts, contaminants and spots can be removed abutting the brush member 65 combined with the lower portion of the suction head 21 to the bottom surface.

The blade installed in the suction head 21 prevents the cleaning water injected through the injection nozzle 61 from being leaked to the outside of the suction head 21 and restricts the flow of the cleaning water in the inner side area of the blade 63, thus to suck the cleaning water injected from the injection nozzle 61 through the suction ports 22A and 22B easily.

The cleaning water sucked through the respective suction ports 22A and 22B flows upward along the suction pipe 23 and then the cleaning water flown the inside of the dust collection case 52 flows downwards gyration along the inside diameter surface of the dust collection case 52.

At this time, foreign materials having relatively larger particles compared with that of the cleaning water circle along the inside diameter surface, move downward, lose kinetic energy and are collected to the lower side of the dust collection case 52. The cleaning water with relatively light gravity is separated from the foreign materials and sucked to the impeller 31 through the impeller suction pipe 32.

Then, the cleaning water exhausted from the impeller 31 is flown to the inside of the cleaning water tank 41 again and flows to the injection nozzle 61 along the outflow tube 44.

Here, in case the internal pressure of the cleaning water tank 41 is increased by the exhaust pressure of the impeller 31, the pressure valve 34 is opened and air is exhausted to the outside through the pressure drawing tube 33 diverged from the inflow tube 42, thus to draw an excessive pressure.

As described above, the cleaner can operate water cleaning performance circulating the cleaning water along the above process.

On the other hand, in case of cleaning a relatively flat and less contaminated surface, such as floors and bottom of rooms, cleaning can be performed efficiently as described above after inserting and combining only duster member 71 in the coupling portion 28 formed on the lower surface of the suction head 21 and supplying proper amount of cleaning water in the cleaning water tank 41.

The brush member can be used combined with the duster member 71 as described above.

Also, in case of cleaning severely contaminated area, the cleaning efficiency can be improved if cleaning is performed again after exchanging the cleaning water inside the cleaning water tank 41 into clean water after performing cleaning circulating the cleaning water and supplying a proper amount of cleansing agent through the supply tube 43.

In case of exhausting cleaning water after performing cleaning operation, when the driving motor 35 and impeller 31 is operated under the condition that the cleaner is leaned forward or backward, that is, the suction head 21 is separated from the bottom surface to certain degree, the cleaning water injected through the injection nozzle 61 from the cleaning water tank 41 is not sucked again through the suction ports 22A and 22B and accordingly the cleaning water is exhausted.

Also, to clean the dust collection case 52 where the foreign materials are collected, the dust collection case 52 is separated from the impeller housing 37 and the suction pipe 23 and the cleaning operation is easily completed by removing the foreign materials in the inside the case.

FIGS. 8 to 11 are views showing the water circulation cleaner according to the other embodiment of the present invention.

Figure 8:
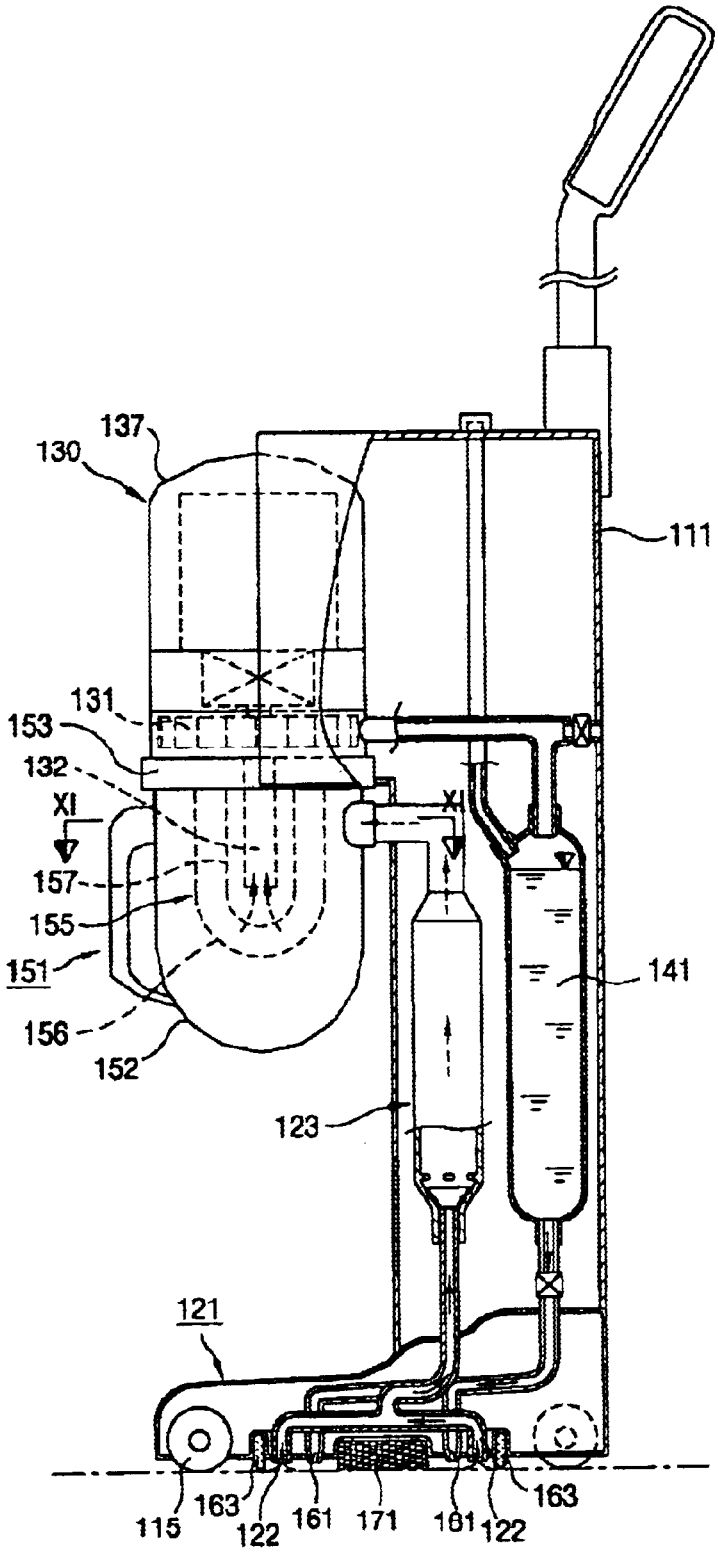
FIG. 8 is a longitudinal sectional view showing the water circulation cleaner according to another embodiment of the present invention.

With reference to FIG. 8, the water circulation cleaner according to the other embodiment of the present invention includes the main case 111, the suction head 121 combined at the lower side of the main case 111 as a single body, the impeller assembly 130 positioned in the main case 111, for generating a suction force, the filter unit 151 positioned in the suction passage between the suction head 121 and the impeller assembly 130, for separating foreign materials included in the suction fluid, the cleaning water tank 141 installed in the main case 111 and connected to the discharging port of the impeller assembly 130, for storing the cleaning water inside and the injection nozzle 161 positioned on the bottom surface of the suction head 121, for injecting the cleaning water supplied from the cleaning water tank 141 on the bottom surface which is the cleaning object.

Such water circulation cleaner according to the other embodiment of the present invention basically has the same or similar composition to that of the formerly described embodiment except the composition of the suction head 121 and the filter unit 151. Therefore, the composition will be described centering around the different parts from the above-described embodiment.

Figure 9:
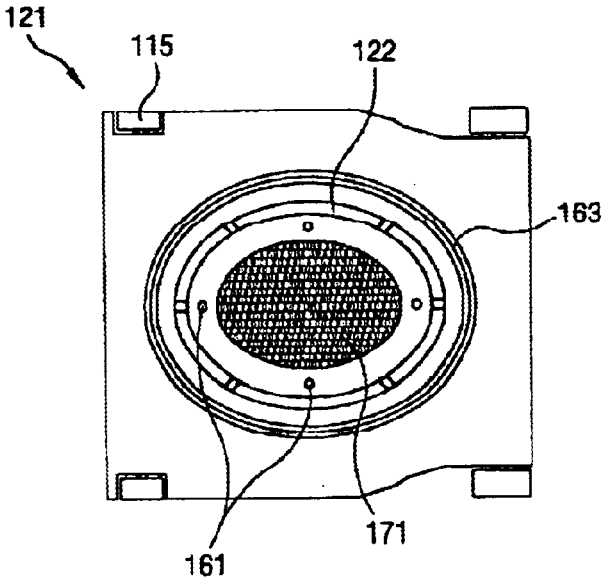
FIG. 9 is a bottom view showing the water circulation cleaner according to another embodiment of the present invention.

First, with reference to FIGS. 8 and 9, rollers 115 are installed at the front, back, right and left sides of the suction head 121 and a blade 163 for preventing leakage of cleaning water is installed on the lower surface. Here, the blade 163 is installed having an elliptic shape on the bottom surface of the suction head 121.

In the inner area of the blade 163, a suction port 122 also having an elliptic shape is formed and a duster member 171 having an elliptic shape is combined at the inner side of the suction port 122 separably. A brush member can be used being combined instead of the duster member 171.

A plurality of injection nozzles 161 are installed between the suction port 122 and the duster member 177 to inject the cleaning water supplied from the cleaning water tank 141 to the bottom surface.

As described above, the blade 163, suction port 122, duster member 171 and the like are installed in the suction head 121 according to the other embodiment of the present invention to have an elliptic structure.

Figure 10:
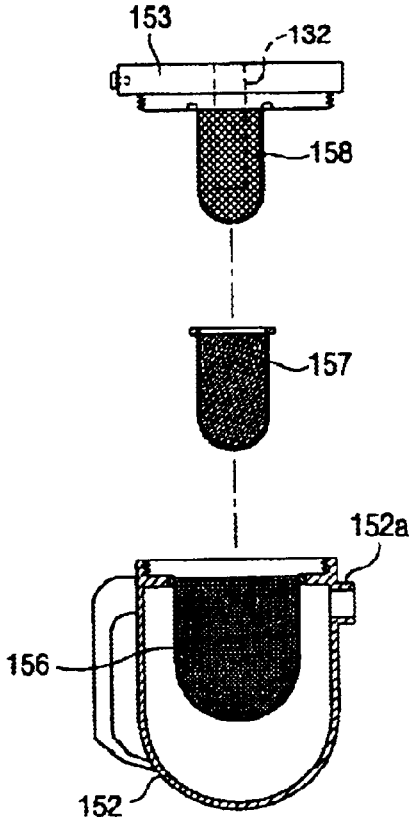
FIG. 10 is a partially sectional view showing the filter member of the water circulation cleaner according to another embodiment of the present invention.
Figure 11:
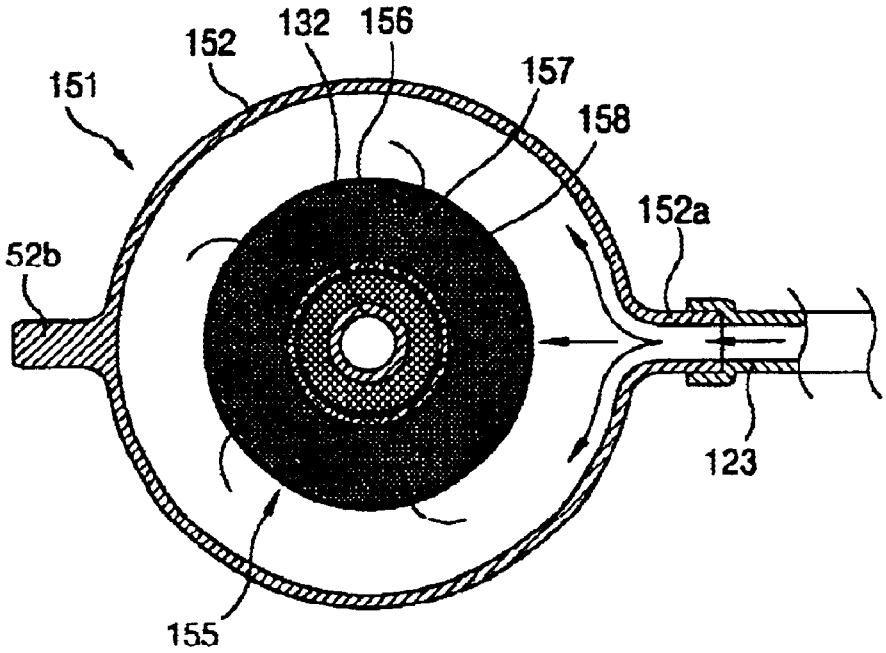
FIG. 11 is a sectional view taken along section line XI—XI of FIG. 8.

Next, with reference to FIGS. 8, 10 and 11, the filter unit 151 of the above described embodiment employs the cyclone dust collection method and on the other hand, a filter member 151 of refining method is used in the other embodiment.

Namely, in the filter unit 151, filter members 155 having a 'U' shape double filter structure are installed inside a filter cap 153 and filter case 152 combined each other.

In the filter case 152, a protrusion port 152A connected to a suction pipe 123 is formed at the side surface and an impeller suction pipe 132 composing the suction side of an impeller 131 passes through the center portion of the filter cap 153.

The filter member 155 includes a first filter member 156 positioned at the inner lower portion of the filter case 152 having a relatively small number of meshes to filter large particles, a second filter member 157 positioned at the side of the impeller suction pipe 132 having a relatively large number of meshes to filter small particles.

Here, the first filter member 156 having the conventional mesh screen structure separates foreign materials included in the suction fluid and the second filter member 157 is composed of filter materials such as nonwaven fabric and the like covered on the circumference of a supporting screen 158 which is fixed to the filter cap 153.

The second filter member 157 can be composed using filter materials which are conventionally used as an oil filter of a car.

In such filter unit 151, foreign materials with large particles included in the cleaning water flown to the filter case 152 through the suction pipe 123 is filtered at the first filter member 156 and more minute foreign materials are filtered passing through the second filter member 157 The cleaning water passed through the second filter member 157 is flown to an impeller housing 137 through the impeller suction pipe 132 and circulated being injected through the injection nozzle 161 after being flown to the cleaning water tank.

On the other hand, in the first and second embodiments described above, the brush member or duster member is disclosed as combined on the lower surface of the suction head separably but the cleaner can wipe out foreign materials by having a duster member of a roller shape rotating the duster member centering on the rotation shaft.

Also, by composing the brush member as a rotatable roller type electric brush, the foreign materials existing in the cleaning object can be removed rotary operating the brush member.

As described above, since the water circulation cleaner in accordance with the present invention is composed capable of removing foreign materials recirculating the cleaning water after injecting the water on the cleaning object surface, the foreign materials such as contaminants and the like on the bottom surface can be efficiently removed and floors of bathrooms or concrete floors can be cleaned easily.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A water circulation cleaner, comprising:

a main case;

a suction head installed at a lower portion of the main case, comprising a suction port configured to suck debris and fluid from a surface of a cleaning object into the suction port;

an impeller assembly installed at one side of the main case and configured to generate a suction force;

a filter device positioned in a suction passage formed between the suction head and the impeller assembly and configured to filter out debris sucked in with the fluid;

a cleaning water tank provided in the main case and connected to a discharging port of the impeller assembly, wherein the cleaning water tank is configured to store cleaning water therein; and a plurality of injection nozzles positioned in the suction head and configured to inject cleaning water supplied from the cleaning water tank onto the surface of the cleaning object.

2. The cleaner of claim 1, further comprising a plurality of rollers installed at the front and rear portions of the suction head and configured to provide for movement of the cleaner.

3. The cleaner of claim 1, wherein the suction head comprises at least one of a brush member and a duster member.

4. The cleaner of claim 3, wherein the at least one of a brush member and a duster member are configured to remove debris from the cleaning object.

5. The cleaner of claim 1, wherein the suction head further comprises a blade configured to prevent an outflow of the cleaning water injected by the plurality of injection nozzles to an area outside of the suction port.

6. The cleaner of claim 5, wherein the blade is configured to be attached to a lower surface of the suction head, and wherein the blade is substantially trapezoidal in shape.

7. The cleaner of claim 6, wherein the suction head comprises at least one of a brush member and duster member configured to remove debris from the cleaning object and wherein the suction port is formed at a portion of the suction head which is to a rear of where the at least one of a brush member and a duster member are installed.

8. The cleaner of claim 7, wherein the plurality of injection nozzles are positioned between the suction port positioned at a front portion of the suction head and the at least one of a brush member and a duster member.

9. The cleaner of claim 5, wherein the blade comprises an elliptical structure that it is connected to a lower surface of the suction head.

10. The cleaner of claim 9, wherein the suction port is formed in a substantially elliptical shape within an internal area formed by the blade.

11. The cleaner of claim 10, wherein at least one of a brush member and a duster member is installed within an internal area formed by the suction port.

12. The cleaner of claim 11, wherein the plurality of injection nozzles are formed between the suction port and the at least one of a brush member and a duster member.

13. The cleaner of claim 5, wherein the blade further comprises an end blade extending from the lower end portion of the blade and sloped inward toward the suction port.

14. The cleaner of claim 1, further comprising a suction pipe configured to form a suction passage between the suction head and the filter device, and a back-ward-flow-preventing valve configured to prevent a backward flow of the cleaning water.

15. The cleaner of claim 14, wherein the suction pipe comprises an expansion pipe formed expanded in a radial direction in a center portion thereof.

16. The cleaner of claim 1, wherein the filter device is configured to be coupled with the impeller assembly outside the main case.

17. The cleaner of claim 1, wherein the filter device comprises a hydro-cyclone dust collection structure.

18. The cleaner of claim 17, wherein the filter device comprises a dust collection case, wherein a radius of the dust collection case becomes more narrow as it goes from an upper to a lower portion of the dust collection case, so as to form a cyclone dust collection structure due to a gyration movement of fluid.

19. The cleaner of claim 18, wherein the dust collection case comprises a protrusion port configured to suck cleaning water containing debris, and an impeller suction tube formed extending vertically from an upper central portion of the impeller assembly.

20. The cleaner of claim 19, wherein the protrusion port is formed protruded in a direction of a line tangent to a flat surface of the dust collection case.

21. The cleaner of claim 19, wherein the protrusion port is formed sloped downward in a direction of an inner side of the dust collection case.

22. The cleaner of claim 1, wherein the filter device comprises a filter case configured to receive a filter member configured to filter out debris when cleaning water sucked into the filter case passes through the filter member.

23. The cleaner of claim 22, wherein the filter device further comprises:

a protrusion port formed on a side surface of the filter case and configured to suck cleaning water into the filter case; and a cap separably attached to an upper portion of the filter case proximate an impeller suction pipe of the impeller assembly.

24. The cleaner of claim 22, wherein the filter member comprises:

a first filter member positioned at an inner lower portion of the filter case, comprising a relatively small number of meshes and configured to filter out debris with a large particle size; and a second filter member positioned at a side of the impeller suction pipe, comprising a relatively large number of meshes compared to the first filter member and configured to filter out debris with a small particle size.

25. The cleaner of claim 1, wherein the impeller assembly comprises:

an impeller housing fixed to the main case;

an impeller configured to generate a force which causes cleaning water containing debris which have passed through the filter device to flow; and a driving motor installed at an upper inner portion of the impeller housing, and configured to provide a rotary driving force to the impeller.

26. The cleaner of claim 25, wherein the impeller assembly further comprises a sealing device positioned between the impeller and the driving motor and configured to prevent an inflow of the cleaning water to the driving motor.

27. The cleaner of claim 1, wherein the cleaning water tank is formed in a substantially cylindrical shaped lengthened in the vertical direction, and connected to an inflow tube connected to the impeller assembly and an outflow tube connected to the plurality of injection nozzles.

28. The cleaner of claim 27, wherein the inflow tube includes a pressure drawing device configured to lower a pressure between an exhaust side of the impeller and the cleaning water tank by being opened when the pressure reaches a predetermined level.

29. The cleaner of claim 28, wherein the pressure drawing device comprises:

a pressure drawing rube diverged from the inflow tube and connected to an outer portion of the main case; and a pressure valve installed in the pressure drawing tube and configured to open when the pressure between the exhaust side of the impeller and the cleaning water tank reaches the predetermined level.

30. The cleaner of claim 27, wherein an open/close valve configured to open and close the cleaning water tank is installed in the outflow tube and is configured to prevent an outflow of the cleaning water stored in the cleaning water tank.

31. The cleaner of claim 1, further comprising:

a supply tube in communication with an outside of the main case and connected to the cleaning water tank, wherein the supply tube is configured to fill the cleaning water tank with cleaning water; and a cap installed in an inlet portion of the supply tube and configured to close the cleaning water tank.

* * * * *